US007314081B2

(12) United States Patent
Tokarek

(10) Patent No.: US 7,314,081 B2
(45) Date of Patent: Jan. 1, 2008

(54) PUMPING FROM TWO LEVELS OF A POOL OF PRODUCTION FLUID, AND ONE WAY VALVE THEREFORE

(75) Inventor: Wade Tokarek, Lloydminster (CA)

(73) Assignee: 1075878 Alberta Ltd., Lloydminster, Alberta (CA)

( * ) Notice: Subject to any disclaimer, the term of this patent is extended or adjusted under 35 U.S.C. 154(b) by 301 days.

(21) Appl. No.: 11/083,813

(22) Filed: Mar. 17, 2005

(65) Prior Publication Data

US 2005/0236156 A1 Oct. 27, 2005

(30) Foreign Application Priority Data

Mar. 18, 2004 (CA) ..... 2461364

(51) Int. Cl.
*E21B 43/14* (2006.01)
*E21B 27/04* (2006.01)

(52) U.S. Cl. ..... 166/110; 166/108; 166/369; 417/404; 417/418; 417/904

(58) Field of Classification Search ..... 166/369, 166/313, 54.1, 105, 110, 111, 108, 325; 417/904, 417/404, 435, 534, 418, 449
See application file for complete search history.

(56) References Cited

U.S. PATENT DOCUMENTS 2,284,505 A * 5/1942 Zehner ..... 417/526
2,499,357 A * 3/1950 Coberly ..... 166/54.1
2,605,712 A * 8/1952 Davis et al. ..... 166/54.1
2,642,803 A * 6/1953 Morris et al. ..... 166/54.1
2,752,855 A * 7/1956 Greene ..... 417/358
2,799,226 A * 7/1957 Kangas ..... 166/54.1
2,933,043 A 4/1960 Furrer
2,961,966 A * 11/1960 Zillman et al. ..... 417/339
4,541,783 A 9/1985 Walling
4,643,258 A * 2/1987 Kime ..... 166/369
4,871,302 A 10/1989 Clardy et al.
5,494,102 A 2/1996 Schulte
5,497,832 A * 3/1996 Stuebinger et al. ..... 166/369
6,076,599 A * 6/2000 McKinzie ..... 166/105
6,585,049 B2 * 7/2003 Leniek, Sr. ..... 166/369
6,817,409 B2 * 11/2004 Howard ..... 166/108
2002/0189805 A1 * 12/2002 Howard ..... 166/108
2003/0037929 A1 * 2/2003 Leniek, Sr. ..... 166/369

* cited by examiner

*Primary Examiner*—Jennifer H Gay
(74) *Attorney, Agent, or Firm*—Fulbright & Jaworski L.L.P.

(57) ABSTRACT

A method of pumping upper production fluid from an upper level of an underground pool of production fluid and pumping lower production fluid having a higher concentration of sand from a lower level during a single pump cycle comprises providing a dual action reciprocating piston pump comprising a pump barrel and a reciprocating piston dividing the pump barrel into a lower and upper chambers. On a downstroke upper production fluid is drawn from the upper level into the upper chamber through an upper intake, and lower production fluid present in the lower chamber is forced up a tube toward ground surface. On an upstroke lower production fluid is drawn from the lower level into the lower chamber through a lower intake, and upper production fluid in the upper chamber is forced up the tube toward ground surface.

6 Claims, 3 Drawing Sheets

PUMPING FROM TWO LEVELS OF A POOL OF PRODUCTION FLUID, AND ONE WAY VALVE THEREFORE

This invention is in the field of pumps and in particular dual action pumps for pumping oil from subterranean formations, and one way valves for such pumps.

BACKGROUND

In certain oil producing areas considerable sand, water and like impurities are present in the producing formation in significant amounts in addition to the desired oil. It is not uncommon for the production fluid pumped from such wells to contain more sand and water than oil. Pumping such mixed production fluid presents problems, since the sand especially causes premature wear of seals and other pump parts. Also where considerable sand is present the sand can settle out of the fluid and plug tubing or pack over anchors and thus interfere with retrieval of down-hole tools, pumps, and the like.

Typically in oil wells a casing is fixed into the well. The depth and thickness of the producing formation is known and perforations are blown through the casing and into the formation along a perforated interval from about the top of the producing formation to the bottom. Production fluid made up of oil, sand, water, and the like, depending on the makeup of the formation, flows through the perforations into the well casing and fills the casing to the level of the perforations, and sometimes well up the casing above the formation, depending on the formation pressure.

A pump is then placed in the well and typically is anchored to a fixed location in the casing where the pump intake will remain, during pumping, covered by production fluid so that same may be drawn in by the pump and raised to the surface.

Where production fluid comprises oil, sand, and water, the production fluid standing in the well casing tends to separate vertically such that the production fluid near the surface of the production fluid in the casing contains a greater proportion of oil, which is lighter, while the production fluid lower down in the casing will contain a greater proportion of heavier water and sand, with the proportion of sand, being the heaviest, greater nearer the bottom.

Typically the pump intake is located near the bottom of the perforated interval where sand concentration is heaviest. At times the sand concentration is such that pumping the production fluid with conventional pumps is problematic.

One type of oil production pump uses a piston that moves up and down in a hollow cylinder or pump barrel. The piston is typically moved up and down by a string of rods or tubing, or can also be reciprocated up and down using pressurized fluid. The production fluid can be pushed up the inside of a tubing string located inside the well casing to the surface. If the pump is sealed in the casing the production fluid can be forced into the casing above the pump and so up to the surface.

Such pumps can be either single action, pushing production fluid to the surface on only the upstroke or the downstroke, or dual action, pushing production fluid to the surface on both the upstroke and the downstroke. Where the production fluid contains significant proportions of sand, it is desirable to use a dual action pump in order to keep the production fluid moving up toward the surface. With a single action pump, the production fluid stands still for about half the time, allowing sand to settle out and potentially cause problems. It is preferred to keep the production fluid in motion to reduce the tendency of the sand to settle out.

Such dual action pumps are disclosed in U.S. Pat. No. 4,541,783 to Walling, U.S. Pat. No. 4,871,302 to Clardy et al., U.S. Pat. No. 5,494,102 to Schulte and U.S. Pat. No. 2,933,043 to Furrer, and in United States Patent Application Publication Number 2002/0189805 of Howard. These dual action reciprocating piston pumps use one-way check valves in a variety of configurations to alternately open and close pathways from the production fluid in the casing into the pump barrel on both sides of the piston and then out to the upper casing or tubing and up to the surface. The prior art dual action pumps generally draw production fluid for both the upstroke and the downstroke from substantially the same location at the bottom of the pump.

SUMMARY OF THE INVENTION

It is an object of the present invention to provide a dual action reciprocating piston pump that overcomes problems in the prior art. It is a further object of the present invention to provide such a pump that can be configured to pump from two separated vertical intake locations in a well casing. It is a further object of the present invention to provide such a pump wherein the vertical separation of the intake locations can be readily adjusted. It is a further object of the present invention to provide such a pump that is simpler in operation than prior art pumps.

It is a further object of the present invention to provide an improved one-way check valve. It is a further object of the present invention to provide such a valve for use in a reciprocating piston pump.

The present invention provides, in a first embodiment, a dual action reciprocating piston pump apparatus for pumping production fluid from an upper level of an underground pool of production fluid and a lower level of the underground pool of production fluid during a single pump cycle. The apparatus comprises a pump barrel having a lower end and an upper end when oriented in a generally upright operating position; a piston slidable up and down inside the pump barrel and substantially sealed in the pump barrel such that the piston divides the pump barrel into a lower chamber under the piston and an upper chamber above the piston; a lower barrel intake opening through the pump barrel at the lower end thereof, and an upper barrel intake opening through the pump barrel at the upper end thereof; a lower barrel intake check valve operative to allow production fluid to flow into the lower chamber of the pump barrel through the lower barrel intake opening and operative to prevent production fluid from flowing out of the lower chamber of the pump barrel; an upper barrel intake check valve operative to allow production fluid to flow into the upper chamber of the pump barrel through the upper barrel intake opening and operative to prevent production fluid from flowing out of the upper chamber of the pump barrel; a tube operatively connected to the piston and extending upward from the piston through the upper end of the pump barrel and operatively connected at an upper end thereof to direct production fluid to ground surface; a tube seal operative to seal the tube in the upper end of the pump barrel such that the tube can slide up, and down through the upper end of the pump barrel; a drive operative to move the tube and piston up and down in the pump barrel; a lower tube opening operatively connecting a bottom surface of the piston and the lower chamber with an interior of the tube; an upper tube opening adjacent to a top surface of the piston and operatively connecting the upper chamber with the interior of the tube; a lower tube check valve operative to allow fluid to flow into the interior of the tube through the lower tube opening and operative to prevent fluid from flowing out of the tube; and an upper tube check valve operative to allow fluid to flow into the interior of the tube through the upper tube opening and operative to prevent fluid from flowing out of the tube. Production fluid is drawn from the lower level of the underground pool through the lower barrel intake opening on an upstroke of the piston, and production fluid is drawn from the upper level of the underground pool through the upper barrel intake opening on a downstroke of the piston.

The present invention provides, in a second embodiment, a dual action reciprocating piston pump apparatus for pumping upper production fluid having a first concentration of sand from an upper level of an underground pool of production fluid and pumping lower production fluid having a second concentration of sand greater than the first concentration of sand from a lower level of the underground pool of production fluid during a single pump cycle. The apparatus comprises a pump barrel and a reciprocating piston inside the pump barrel; a lower intake oriented such that lower production fluid is drawn from the lower level of the underground pool into the pump barrel through the lower intake on an upstroke of the piston; and an upper intake oriented at a distance above the lower intake such that upper production fluid is drawn from the upper level of the underground pool into the pump barrel through the upper intake on a downstroke of the piston.

The present invention provides, in a third embodiment, a method of pumping upper production fluid having a first concentration of sand from an upper level of an underground pool of production fluid and pumping lower production fluid having a second concentration of sand greater than the first concentration of sand from a lower level of the underground pool of production fluid during a single pump cycle. The method comprises providing a dual action reciprocating piston pump comprising a pump barrel and a reciprocating piston inside the pump barrel dividing the pump barrel into a lower chamber and an upper chamber; on a downstroke of the piston, drawing upper production fluid from the upper level of the underground pool into the upper chamber through an upper intake, and forcing lower production fluid present in the lower chamber up a tube toward ground surface; on an upstroke of the piston drawing lower production fluid from the lower level of the underground pool into the lower chamber through a lower intake, and forcing upper production fluid in the upper chamber up the tube toward ground surface.

The present invention provides, in a fourth embodiment, a one way valve apparatus for use in a pump having a pump barrel and at least one intake aperture in a wall of the pump barrel adjacent to the top of the pump barrel, and further having a tube extending up through a top end of the pump barrel. The apparatus comprising an annular fixed barrel plate fixed in the pump barrel, under the at least one intake aperture and substantially sealed to walls of the pump barrel and to the tube, the fixed barrel plate defining at least one barrel plate aperture therethrough; an annular barrel sealing plate located under the fixed barrel plate and slidable with respect to the pump barrel and the tube; and a bias element exerting a bias force on the barrel sealing plate toward the fixed barrel plate such that the barrel sealing plate substantially seals the at least one barrel plate aperture.

The dual action reciprocating piston pump of the invention can be configured to draw production fluid from near the top of the production fluid standing in the casing on the downstroke, and draw production fluid from a lower level on the upstroke. In the prior art pumps the pump must be set at some mild point and draw essentially the same production fluid on the upstroke and downstroke. The production fluid drawn off the top has a lesser concentration of sand that will mix with the production fluid drawn from the bottom that has a greater concentration of sand, and the pumped production fluid will thus move up the tubing more readily.

While all the sand that flows into the well must be pumped out, by separating the upper and lower intake locations it is possible to avoid pumping production fluid only from the bottom that has a higher concentration of sand than is present in the production fluid as a whole.

The one way check valve of the invention provides a simple and dependable check valve for use in regulating flow in a pump barrel, and simplifies the structure of a dual action reciprocating pump.

DESCRIPTION OF THE DRAWINGS

While the invention is claimed in the concluding portions hereof, preferred embodiments are provided in the accompanying detailed description which may be best understood in conjunction with the accompanying diagrams where like parts in each of the several diagrams are labeled with like numbers, and where:

Figure 1:
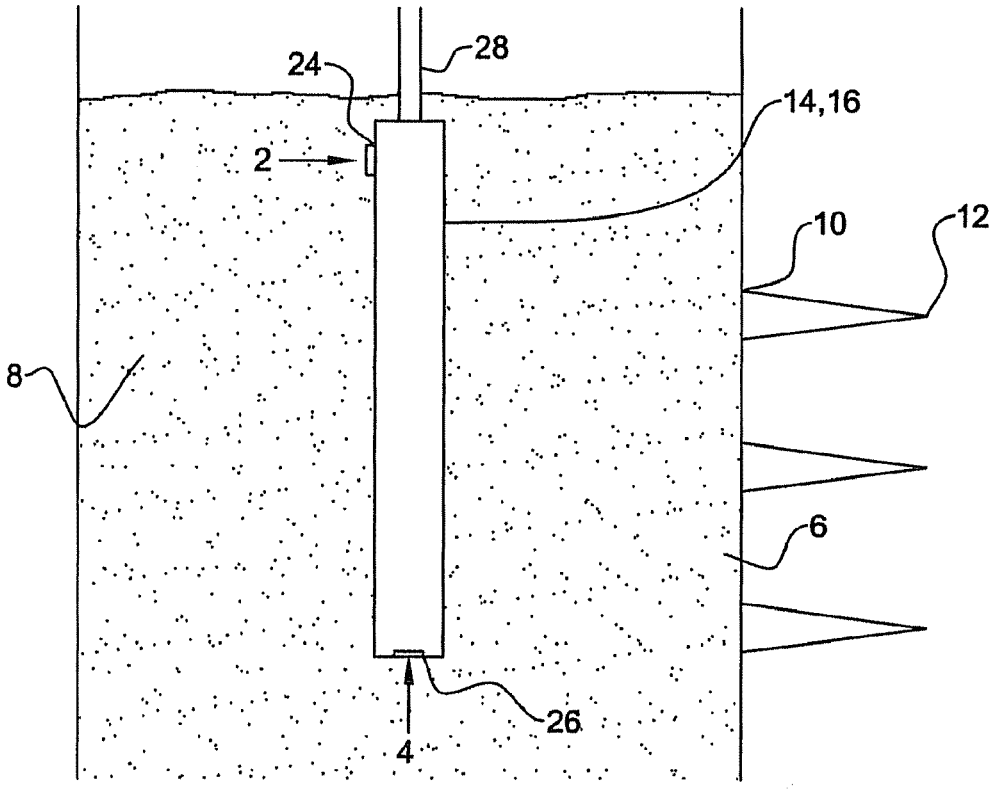
FIG. 1 is a schematic side view of an embodiment of the invention located in an underground pool of production fluid.

DETAILED DESCRIPTION OF THE ILLUSTRATED EMBODIMENTS:

FIG. 1 schematically illustrates a method of pumping upper production fluid 2 having a first concentration of sand 6 from an upper level of an underground pool 8 of production fluid and pumping lower production fluid 4 having a second concentration of sand 6 that is greater than the first concentration of sand 6 from a lower level of the underground pool 8 of production fluid during a single pump cycle. The pool 8 is schematically indicated inside a well casing 10. Production fluid enters the well casing from the producing formation through perforations 12 through the casing 10. While the method can be practiced in other conditions, it is well suited to pumping production fluid that contains a considerable amount of sand 6. In such production fluid the sand 6 is heavier than the liquid water and oil typically present, and so tends to fall to the bottom as it enters the casing such that the upper production fluid 2 has a lesser concentration of sand 6 than the lower production fluid 4.

Figure 3:
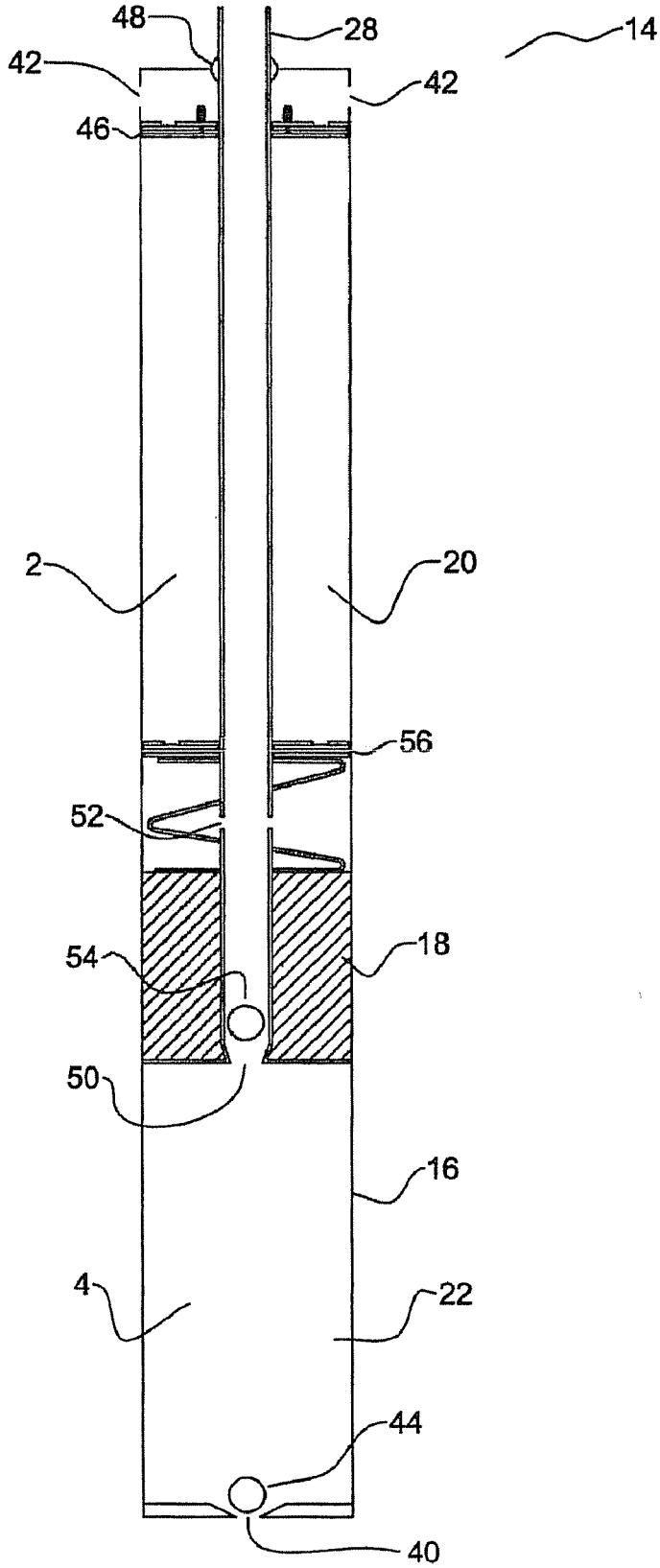
FIG. 3 is a schematic side view of a pump for use in the embodiment of FIG. 1.

The method comprises providing a dual action reciprocating piston pump 14 comprising, as illustrated in FIG. 3, a pump barrel 16 and a reciprocating piston 18 inside the pump barrel 16 dividing the pump barrel 16 into a lower chamber 22 and an upper chamber 20.

The pump 14 is secured inside the casing 10 by an anchor as is known in the art, and is not illustrated in FIG. 1. The size of the pump 14 with respect to the casing 10 in the schematic drawing of FIG. 1 is much reduced in order to more clearly illustrate the method.

On a downstroke of the piston 18, upper production fluid 2 is drawn from the upper level of the underground pool 8 into the upper chamber 20 of the pump barrel 16 through an upper intake 24, and lower production fluid 4 present in the lower chamber 22 is forced up a tube 28 toward ground surface. On an upstroke of the piston 18 lower production fluid 4 is drawn from the lower level of the underground pool 8 into the lower chamber 22 through a lower intake 26, and the upper production fluid 2 in the upper chamber 20 is forced up the tube 28. The lower intake 26 is illustrated on the bottom wall of the pump barrel 16, however could also be located on the side wall of the bottom end of the pump barrel 16 if it is desired leave the bottom end of the pump barrel 16 clear.

The upper and lower intakes 24, 26 can be located at a desired vertical separation distance by extending or reducing the length of the pump barrel 16 such that the lower intake 26 is located in the lower level of the underground pool 8 and the upper intake 24 is located in the upper level of the underground pool 8.

Figure 2:
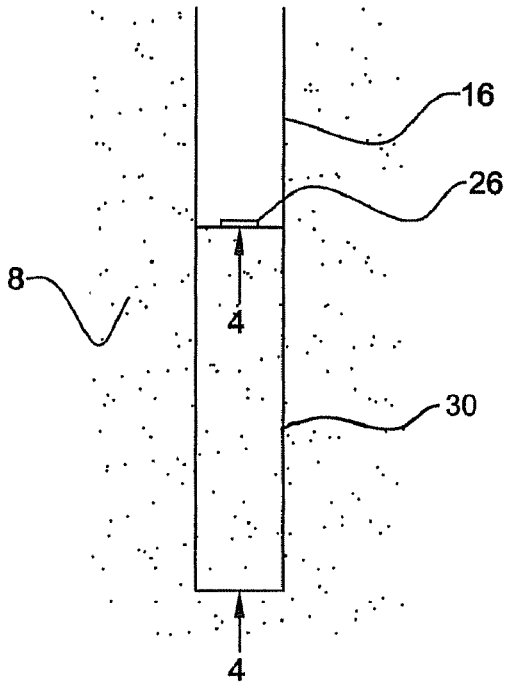
FIG. 2 is a schematic side view of an alternate embodiment of the invention including an intake extension.

Alternatively as illustrated in FIG. 2, an intake extension 30 can be provided extending down from the pump barrel 16. Lower production fluid 4 from the lower level of the underground pool 8 is then drawn into the pump barrel 16 through the bottom end of the intake extension 30 located at the lower level of the underground pool 8 and up the intake extension 30 through the lower intake 26. The intake extension 30 can conveniently be provided by threading a pipe of the correct length to provide desired vertical separation on to the bottom end of the intake extension 30.

Using the method of the invention, the production fluid moving up the tube 28 to the surface is made up of upper production fluid 2, having a lesser concentration of sand 6, and lower production fluid 4, having a greater concentration of sand 6. Thus the production fluid in the tube 28 is less likely to plug, since the alternating lesser sand containing upper production fluid 2 will move more readily and carry the lower production fluid 4 with it. As well, the dual action pump 14 maintains a substantially constant flow of production fluid up the tube 28 so that at no time does the production fluid stand still and thus allow sand to settle out.

FIG. 3 schematically illustrates further details of an embodiment of a dual action reciprocating piston pump 14 suitable for pumping production fluid from an upper level of an underground pool of production fluid and a lower level of the underground pool of production fluid during a single pump cycle as described above for the method of FIG. 1.

The pump 14 comprises a pump barrel 16 having a lower end and an upper end when oriented in a generally upright operating position as illustrated in FIG. 3. The pump 14 is anchored in a well casing in a conventional manner that has not been illustrated.

A piston 18 is slidable up and down inside the pump barrel 16 and is substantially sealed in the pump barrel 16. The piston 18 divides the pump barrel 16 into a lower chamber 22 under the piston 18 and an upper chamber 20 above the piston 18. The lower intake 24 of FIG. 1 comprises a lower barrel intake opening 40 through the pump barrel 16 at the lower end thereof, and the upper intake 26 of FIG. 1 comprises upper barrel intake openings 42 through the pump barrel 16 at the upper end thereof. With the configuration illustrated there is sufficient room that the upper barrel intake openings 42 can be sized as large as is required to ensure that production fluid containing sand will pass through.

A lower barrel intake check valve 44 is operative to allow lower production fluid 4 to flow into the lower chamber 22 of the pump barrel 16 through the lower barrel intake opening 40 and operative to prevent lower production fluid 4 from flowing out of the lower chamber 22.

An upper barrel intake check valve 46 operative to allow upper production fluid 2 to flow into the upper chamber 20 of the pump barrel 16 through the upper barrel intake openings 42 and operative to prevent upper production fluid 2 from flowing out of the upper chamber 20.

The tube 28 is operatively connected to the piston 18 and extends upward from the piston 18 through the upper end of the pump barrel 16 and is operatively connected at an upper end thereof to direct production fluid to ground surface (not shown).

A drive is operative to move the tube 28 and attached piston 18 up and down in the pump barrel 16. A tube seal 48 is operative to seal the tube 28 in the upper end of the pump barrel 16 such that the tube 28 can slide up and down through the upper end of the pump barrel 16.

A lower tube opening 50 operatively connects the bottom surface of the piston 18, and thus the lower chamber 22, with the interior of the tube 28. An upper tube opening 52 adjacent to a top surface of the piston 18 operatively connects the upper chamber 20 with the interior of the tube 28. A lower tube check valve 54 is operative to allow lower production fluid 4 to flow into the interior of the tube 28 through the lower tube opening 50 and is operative to prevent lower production fluid 4 from flowing out of the tube 28.

An upper tube check valve 56 is operative to allow upper production fluid 2 to flow into the interior of the tube 28 through the upper tube opening 52 and is operative to prevent upper production fluid 2 from flowing out of the tube 28.

As illustrated in FIG. 1, when using the embodiment of FIG. 3, lower production fluid 4 is drawn from the lower level of the underground pool 8 through the lower barrel intake opening 40 on an upstroke of the piston 18, and upper production fluid 2 is drawn from the upper level of the underground pool 8 through the upper barrel intake openings 42 on a downstroke of the piston 18.

Figure 4:
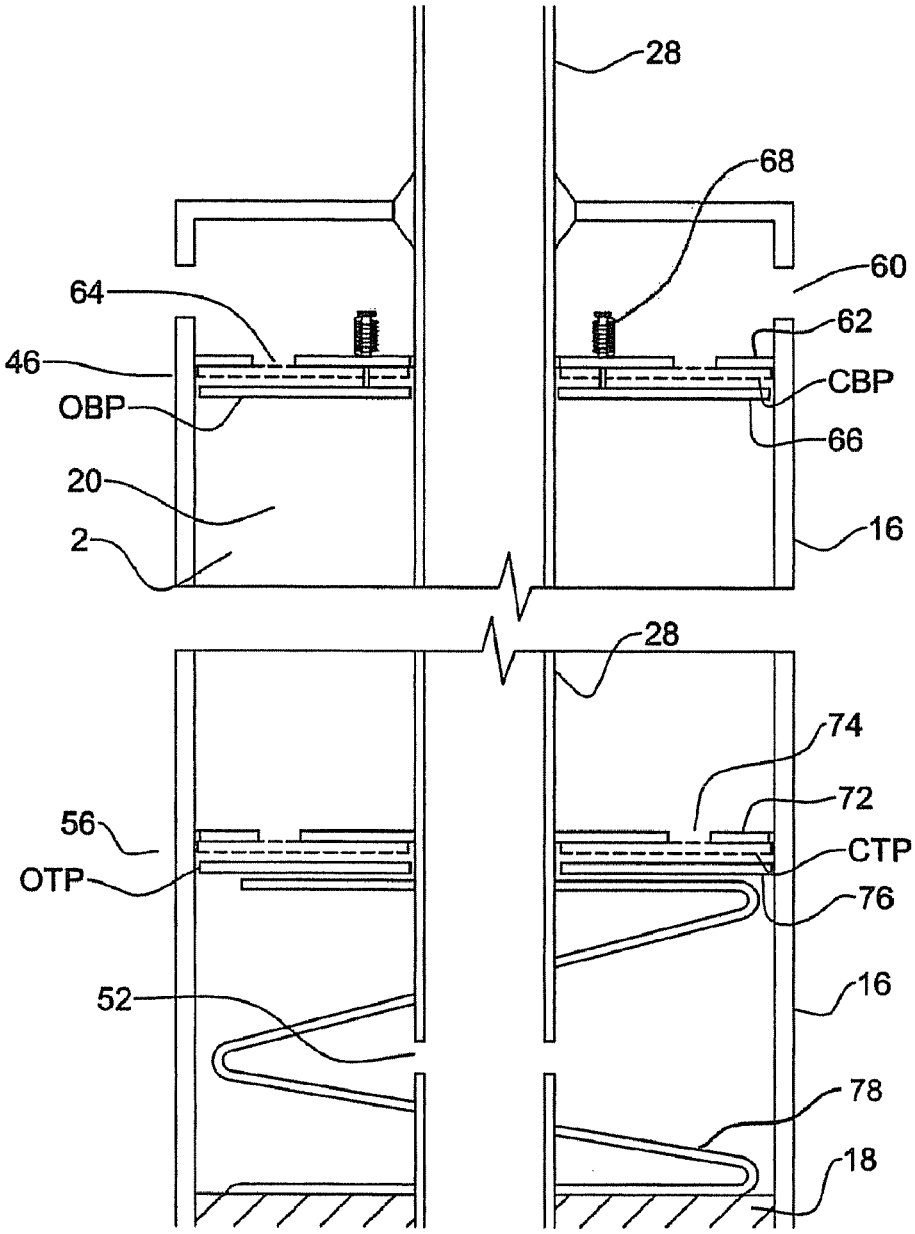
FIG. 4 is schematic side view of the check valves of the pump of FIG. 3.

As illustrated in FIG. 4, the upper barrel intake openings 42 comprise a plurality of intake apertures 60 in the side wall of the pump barrel 16 adjacent to the top of the upper chamber 20. The illustrated upper barrel intake check valve 46 comprises an annular fixed barrel plate 62 fixed in the pump barrel 16 under the intake apertures 60 and sealed to walls of the pump barrel 16 and to the tube 28. The fixed barrel plate 62 defines a plurality of barrel plate aperture 64 therethrough.

An annular barrel sealing plate 66, shaped essentially like a washer, is located under the fixed barrel plate 62 and is slidable with respect to the pump barrel 16 and the tube 28.

Figure 5:
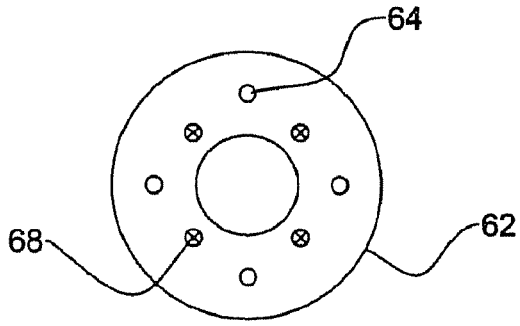
FIG. 5 is a schematic top view of the fixed barrel plate of the upper check valve illustrated in FIG. 4.

An upper bias element, illustrated as upper springs 68, exerts a bias force on the barrel sealing plate 66 toward the fixed barrel plate 60 such that, in the absence of an opposite force, the barrel sealing plate 66 is forced against the fixed barrel plate 62 and seals the barrel plate apertures 64 when in the closed barrel position CBP indicated by the dotted lines in FIG. 4. As illustrated in FIG. 5, the barrel plate apertures 64 and upper springs 68 are substantially equally spaced around the fixed barrel plate 62. With this configuration the barrel sealing plate 66 is substantially balanced so that it will not tend to bind when sliding on the tube 28.

The tube 28 is driven up and down by a conventional drive such as a pump jack or the like to move the piston 18 up and down. When the piston 18 moves downward, a vacuum force is exerted on the barrel sealing plate 66 that overcomes the bias force exerted by the upper bias element, springs 68, and causes the barrel sealing plate 66 to move down away from the fixed barrel plate 62 to the open barrel position OBP such that upper production fluid 2 is drawn into the upper chamber 20 through the intake apertures 60 and the barrel plate apertures 64.

The upper tube check valve is of a design analogous to that of the upper barrel intake check valve 46 and comprises an annular fixed tube plate 72 fixed to the tube 28 above the upper tube openings 52 and sealed to walls of the pump barrel 16 and to the tube 28. The fixed tube plate 72 defines a plurality of tube plate apertures 74 therethrough.

An annular tube sealing plate 76, again shaped essentially like a washer, is located under the fixed tube plate 72 and above the upper tube openings 52 and is slidable with respect to the pump barrel 16 and the tube 28.

A lower bias element, illustrated as lower coil spring 78, exerts a bias force on the tube sealing plate 76 toward the fixed tube plate 72 such that, in the absence of an opposite force, the tube sealing plate 76 is forced against the fixed tube plate 72 and seals the tube plate apertures 74 in the fixed tube plate 72 when in the closed barrel position CTP indicated by the dotted lines in FIG. 4.

When the piston 18 moves upward, the upper production fluid 2 tries to move up with the piston 18 and thus exerts a force against the barrel sealing plate 66 towards the fixed barrel plate 62 which reinforces the bias force exerted by the upper springs 68 and forces the barrel sealing plate 66 against the fixed barrel plate 62 and seals the barrel plate apertures 64. With no where to go, the upper production fluid 2 in the upper chamber 20 exerts a force on the tube sealing plate 76 that overcomes the bias force exerted by the lower coil spring 78 and causes the tube sealing plate 76 to move down away from the fixed tube plate 72 to the open tube position OTP such that upper production fluid 2 is forced through the tube plate apertures 52 and into the interior of the tube 28 and up to the ground surface.

As described above the check valve of the invention provides a simple and cost effective check valve for use in a dual action reciprocating piston pump.

The foregoing is considered as illustrative only of the principles of the invention. Further, since numerous changes and modifications will readily occur to those skilled in the art, it is not desired to limit the invention to the exact construction and operation shown and described, and accordingly, all such suitable changes or modifications in structure or operation which may be resorted to are intended to fall within the scope of the claimed invention.

What is claimed is:

1. A dual action reciprocating piston pump apparatus for pumping production fluid from an upper level of an underground pool of production fluid and a lower level of the underground pool of production fluid during a single pump cycle, the apparatus comprising:

a pump barrel having a lower end and an upper end when oriented in a generally upright operating position;

a piston slidable up and down inside the pump barrel and substantially sealed in the pump barrel such that the piston divides the pump barrel into a lower chamber under the piston and an upper chamber above the piston;

a lower barrel intake opening through the pump barrel at the lower end thereof, and an upper barrel intake opening through the pump barrel at the upper end thereof;

a lower barrel intake check valve operative to allow production fluid to flow into the lower chamber of the pump barrel through the lower barrel intake opening and operative to prevent production fluid from flowing out of the lower chamber of the pump barrel;

an upper barrel intake check valve operative to allow production fluid to flow into the upper chamber of the pump barrel through the upper barrel intake opening and operative to prevent production fluid from flowing out of the upper chamber of the pump barrel;

a tube operatively connected to the piston and extending upward from the piston through the upper end of the pump barrel and operatively connected at an upper end thereof to direct production fluid to ground surface;

a tube seal operative to seal the tube in the upper end of the pump barrel such that the tube can slide up and down through the upper end of the pump barrel;

wherein the tube is adapted for connection to a drive operative to move the tube and piston up and down in the pump barrel;

a lower tube opening operatively connecting a bottom surface of the piston and the lower chamber with an interior of the tube;

an upper tube opening adjacent to a top surface of the piston and operatively connecting the upper chamber with the interior of the tube;

a lower tube check valve operative to allow fluid to flow into the interior of the tube through the lower tube opening and operative to prevent fluid from flowing out of the tube;

an upper tube check valve operative to allow fluid to flow into the interior of the tube through the upper tube opening and operative to prevent fluid from flowing out of the tube;

wherein production fluid is drawn from the lower level of the underground pool through the lower barrel intake opening on an upstroke of the piston, and production fluid is drawn from the upper level of the underground pool through the upper barrel intake opening on a downstroke of the piston;

wherein the upper barrel intake opening comprises at least one intake aperture in a wall of the pump barrel adjacent to the top of the upper chamber, and the upper barrel intake check valve comprises:

an annular fixed barrel plate fixed in the pump barrel, under the at least one intake aperture and substantially sealed to walls of the pump barrel and to the tube, the fixed barrel plate defining at least one barrel plate aperture therethrough;

an annular barrel sealing plate located under the fixed barrel plate and slidable with respect to the pump barrel and the tube;

an upper bias element exerting a bias force on the barrel sealing plate toward the fixed barrel plate such that the barrel sealing plate substantially seals the at least one barrel plate aperture;

wherein when the piston moves downward, a vacuum force is exerted on the barrel sealing plate that overcomes the bias force exerted by the upper bias element and causes the barrel sealing plate to move down away from the fixed barrel plate such that production fluid is drawn into the upper chamber through the at least one intake aperture and the at least one barrel plate aperture.

2. The apparatus of claim 1 wherein the upper tube check valve comprises:

an annular fixed tube plate fixed to the tube above the upper tube opening and substantially sealed to walls of the pump barrel and to the tube, the fixed tube plate defining at least one tube plate aperture therethrough;

an annular tube sealing plate located under the fixed tube plate and above the upper tube opening and slidable with respect to the pump barrel and the tube;

a lower bias element exerting a bias force on the tube sealing plate toward the fixed tube plate such that the tube sealing plate substantially seals the tube plate aperture in the fixed tube plate;

wherein when the piston moves upward, production fluid in the upper chamber exerts a force on the tube sealing plate that overcomes the bias force exerted by the lower bias element and causes the tube sealing plate to move down away from the fixed tube plate such that production fluid is forced through the at least one tube plate aperture and into the interior of the tube.

3. The apparatus of claim 2 wherein the fixed tube plate defines a plurality of tube plate apertures substantially equally spaced around the fixed tube plate.

4. The apparatus of claim 3 wherein the lower bias element comprises a coil spring between the top surface of the piston and the fixed tube plate.

5. The apparatus of claim 1 wherein the fixed barrel plate defines a plurality of barrel plate apertures substantially equally spaced around the fixed barrel plate.

6. The apparatus of claim 5 wherein the upper bias element comprises a plurality of upper springs substantially equally spaced around the fixed barrel plate.

* * * * *